US006481753B2

(12) United States Patent
Van Boom et al.

(10) Patent No.: US 6,481,753 B2
(45) Date of Patent: Nov. 19, 2002

(54) FORM FOR CONCEALING VARIABLE PRINTED INFORMATION

(75) Inventors: Joel Bryan Van Boom, Santa Ana, CA (US); Chuck Casagrande, Gillingham (GB); Bernard Willem "Wim" Scheggetman, Bangkok (TW)

(73) Assignee: Documotion Research, Inc., Wilmington, DE (US)

( * ) Notice: Subject to any disclaimer, the term of this patent is extended or adjusted under 35 U.S.C. 154(b) by 7 days.

(21) Appl. No.: 09/780,722

(22) Filed: Feb. 9, 2001

(65) Prior Publication Data

US 2001/0020785 A1 Sep. 13, 2001

Related U.S. Application Data

(60) Continuation-in-part of application No. 09/505,221, filed on Feb. 16, 2000, now Pat. No. 6,231,082, which is a division of application No. 09/183,116, filed on Oct. 30, 1998, now Pat. No. 6,220,633.

(51) Int. Cl.[7] ..... B42D 15/00

(52) U.S. Cl. ..... 283/72; 283/91; 283/94; 283/109; 283/61; 283/901

(58) Field of Search ..... 283/98, 57, 58, 283/74, 75, 72, 94, 91, 901, 109, 70, 67, 61, 62, 902; 503/227

(56) References Cited

U.S. PATENT DOCUMENTS

| | | | |
|---|---|---|---|
| 1,996,288 | A | 4/1935 | Galt |
| 2,952,080 | A | 9/1960 | Avakian et al. |
| 3,001,886 | A | 9/1961 | Schrewsbuty |
| 3,279,826 | A | 10/1966 | Rudershausen et al. |
| 3,315,386 | A | 4/1967 | Kest et al. |
| 3,520,757 | A | 7/1970 | Heaney et al. |
| 3,675,948 | A | 7/1972 | Wicker |
| 3,891,242 | A | 6/1975 | Arnold et al. |
| 4,109,047 | A | 8/1978 | Fredrickson |
| 4,174,857 | A | 11/1979 | Koza |
| 4,299,637 | A | 11/1981 | Oberdeck et al. |
| 4,379,573 | A | 4/1983 | Lomeli et al. |
| 4,551,373 | A | 11/1985 | Conlon |
| 4,668,597 | A | 5/1987 | Merchant |
| 4,778,153 | A | 10/1988 | Bachman et al. |
| 4,790,565 | A | 12/1988 | Steed |

(List continued on next page.)

FOREIGN PATENT DOCUMENTS

| | | |
|---|---|---|
| EP | 0 271 673 | 6/1988 |
| FR | 1259277 | 3/1961 |
| GB | 851749 | 10/1960 |
| GB | 894081 | 4/1962 |
| GB | 1235941 | 6/1971 |
| GB | 1590274 | 5/1981 |
| WO | WO 91/18376 | 11/1991 |

OTHER PUBLICATIONS

Meyer, H. "Peelable obscuration coatings for responsive answer sheets." *Xerox Disclosure Journal*, vol. 1, No. 3 (Stamford, CT: Mar. 1976). Page 1.—not enclosed.

*Primary Examiner*—William Fridie, Jr.
(74) *Attorney, Agent, or Firm*—St. Onge Steward Johnston & Reens LLC

(57) ABSTRACT

Variable confidential information (12) is printed over scrambling pattern (14) which is formed of thermochromatic ink. Information (12) cannot be read due to the presence of the underlying scrambling pattern. The information becomes readable when heat is applied to the thermochromatic ink and the optical properties of the thermochromatic ink are altered. Preferably, the alteration of the optical properties of the thermochromatic ink is irreversible

4 Claims, 1 Drawing Sheet

U.S. PATENT DOCUMENTS

| | | | | | |
|---|---|---|---|---|---|
| 4,889,365 | A | | 12/1989 | Chouinard | |
| 5,013,088 | A | | 5/1991 | Marin | |
| 5,076,613 | A | | 12/1991 | Kovacs | |
| 5,238,272 | A | | 8/1993 | Taylor | |
| 5,253,899 | A | | 10/1993 | Greenwood | |
| 5,286,061 | A | | 2/1994 | Behm | |
| 5,288,977 | A | | 2/1994 | Amendolia et al. | |
| 5,310,222 | A | | 5/1994 | Chatwin et al. | |
| 5,324,380 | A | | 6/1994 | Marin | |
| 5,346,258 | A | | 9/1994 | Behm et al. | |
| 5,393,099 | A | | 2/1995 | D'Amato | |
| 5,411,295 | A | | 5/1995 | Bates et al. | |
| 5,431,452 | A | | 7/1995 | Chang et al. | |
| 5,551,729 | A | | 9/1996 | Morgan | |
| 5,595,403 | A | | 1/1997 | Garrison | |
| 5,618,112 | A | | 4/1997 | Lovell | |
| 5,839,763 | A | | 11/1998 | McCannel | |
| 5,863,075 | A | | 1/1999 | Rich et al. | |
| 5,873,604 | A | * | 2/1999 | Phillips | 283/72 |
| 5,893,587 | A | | 4/1999 | Wong | |
| 6,022,051 | A | | 2/2000 | Casgrande | |
| 6,030,000 | A | * | 2/2000 | Diamond | 283/58 |
| 6,113,150 | A | | 9/2000 | Kinberg | |
| 6,114,077 | A | | 9/2000 | Voets et al. | |
| 6,220,633 | B1 | * | 4/2001 | Van Boom et al. | 283/100 |
| 6,231,082 | B1 | * | 5/2001 | Van Boom et al. | 283/100 |
| 6,313,067 | B1 | * | 11/2001 | Maruyama | 503/227 |

* cited by examiner

FORM FOR CONCEALING VARIABLE PRINTED INFORMATION

CROSS-REFERENCE TO RELATED APPLICATIONS

The present application is a continuation-in-part of U.S. patent application Ser. No. 09/505,221, filed Feb. 16, 2000 now U.S. Pat. No. 6,231,082, which is a divisional of U.S. patent application Ser. No. 09/183,116, filed Oct. 30, 1998 now U.S. Pat. No. 6,220,633.

FIELD OF THE INVENTION

This invention relates to a form for concealing variable information printed on the form by a printer, e.g. laser, ink jet or impact printer.

BACKGROUND OF THE INVENTION

It is known from International Patent Application PCT/US97/02149 published Sep. 4, 1997 to, during manufacture of a valuable document such as a check or the like, (a) print a background scrambling pattern on the valuable document and (b) overprint or "trap produce" a static message (e.g. "STOP") in thermochromatic ink such that the static message is initially invisible due to the presence of the background scrambling pattern.

Radiant heat generated during photocopying or scanning of the valuable document causes the previously invisible static message (e.g. "STOP") to become visible (e.g. by changing color) such that it is readily apparent that the original valuable document has been copied. Likewise, the static message is visible in any copies of the valuable document.

Thus, this prior art document teaches a device for indicating when a valuable document has been copied by a photocopier or scanner.

SUMMARY OF THE INVENTION

The present invention involves the use of a background scrambling pattern printed during manufacture on a form and upon which, at a time after manufacture, variable confidential information can be printed by a printer such as a laser, ink jet or impact printer. When printed over the background scrambling pattern, the variable confidential information immediately and automatically cannot be read due to the presence of the background scrambling pattern which prevents the observer's eye from discriminating the overlying variable confidential information from the underlying background scrambling pattern.

In order to assist in hiding the confidential information, such information may be printed in a light color or in a light screen density. Additionally, the entire scrambling pattern can be printed with a very light screen so that the confidential message is further hidden among the background screen.

The background scrambling pattern is formed from a thermochromatic ink and the optical characteristics of the background scrambling pattern alter upon the application of heat, such as, for example, the heat generated by a person physical rubbing the form with their fingers. The alteration in the optical characteristics of the background scrambling pattern then allows the variable confidential information to be discriminated from the altered background scrambling pattern.

Desirably, the thermochromatic ink remains irreversibly in its altered state after the heat is removed so that a later observer can determine whether the information has been previously read by a third party. Such an embodiment is tamper-evident. In such an embodiment, a printer must be used that does not generate significant heat, such as a cold laser, ink jet or impact printer.

In another embodiment, the thermochromatic ink may return to its original state, it which case the embodiment is, of course, not tamper-evident. In this case, either a cold or hot printer system could be used to print the confidential information on the form.

The invention and its particular features and advantages will become more apparent from the following detailed description considered with reference to the accompanying drawings.

DETAILED DESCRIPTION OF THE INVENTION

Figure 1:
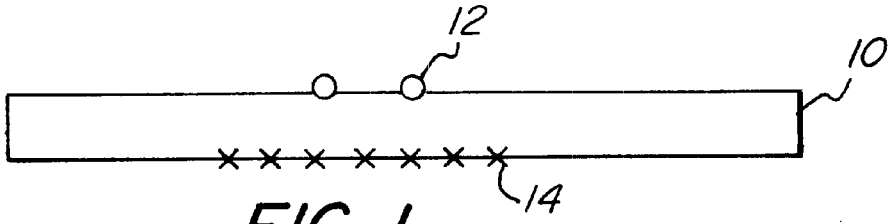
FIG. 1 is a cross sectional view of a first embodiment of the present invention.

With reference firstly to FIG. 1, there is illustrated in cross section a first embodiment of the present invention. The first embodiment is comprised of a transparent sheet of material 10 having a scrambling pattern 14 (schematically represented by a row of "x"s) printed on the underside of the transparent sheet of material 10.

Figure 4:
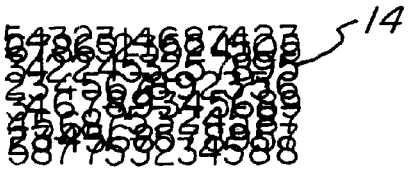

Scrambling pattern 14 typically takes the form of a mass of overprinted alphanumeric characters (see FIG. 4), although it could also take the form of a shaded or patterned area. What is essential is that the scrambling pattern 14 prevents a viewer from discerning the variable confidential information 12 as will be apparent with regard to the following description.

Scrambling pattern 14 is printed with thermochromatic ink during manufacture of the form. The optical characteristics of the scrambling pattern 14 alter at a predetermined temperature which is dictated by the "critical" or "transition" temperature of the thermochromatic ink. In a preferred embodiment the alteration occurs at or about 40 degrees Celsius (i.e. slightly above body temperature) such that a person can rub the form to generate frictional heat to thereby alter the scrambling pattern. However, the transition temperature of the thermochromatic ink could be other than 40 degrees Celsius.

On the upper surface of the transparent sheet of material 10 is printed variable confidential information 12 (schematically represented by a pair of "o"s). Typically, information 12 will be alpha-numeric confidential information, for example a PIN number associated with a credit or debit card. When viewed from above, alphanumeric information 12 cannot discriminated from the background scrambling pattern 14 which is comprised of a mass of overprinted alpha-numeric characters which are clearly visible from above through the sheet of transparent material 10.

In use, variable confidential information 12 is printed onto the upper surface of the transparent sheet of material 10 with a conventional "cold" printer employing conventional ink.

Note that hot laser printers operate at high temperatures which will generally exceed the transition temperature of the thermochromatic ink, depending on the ink chosen.

In order to read the variable confidential information 12, it is necessary to apply heat to the thermochromatic ink which forms the background scrambling pattern. Upon application of heat, for example by rubbing, the thermochromatic ink alters its optical properties thereby rendering the information 12 readable or discernible from the background pattern. Typically, the thermochromatic ink clarifies or lightens such that the background scrambling pattern 14 appears to "fade" and the information 12 "emerges" and becomes plainly visible.

In a highly preferred embodiment, the alteration of the optical properties of the scrambling pattern 14 is irreversible such that the scrambling pattern 14 remains permanently in its altered or faded state, thereby giving a clear indication to the intended recipient that the information 12 has been previously read and compromised by a third party. Of course, if the alteration is not permanent and the thermochromatic ink returns to its original state then the form will not be tamper-evident.

The thermochromatic background scrambling pattern is formed on the form during manufacture. The form is then supplied to a customer such as a bank or the like. In use, the bank or the like prints variable confidential information (such as a PIN) over the background scrambling pattern so as to hide the PIN. When the client of the bank receives the form, they are instructed to rub the form to generate heat and reveal the PIN. In other embodiments where the transition temperature of the thermochromatic ink is higher, the recipient may be instructed to heat the form with an electrical appliance such as a hair drier, hot iron or the like.

Figure 2:
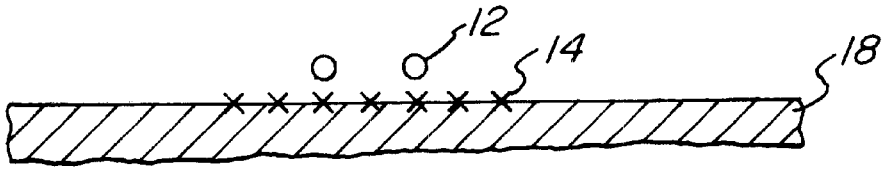
FIG. 2 is a cross sectional view of a second embodiment of the present invention.

Referring now to FIG. 2, there is illustrated in cross section a second embodiment of the invention in which the same reference numerals have been used where possible to indicate the same features. In this embodiment, the transparent sheet 10 has been replaced by a substrate 18 which need not be transparent and both the scrambling pattern 14 and information 12 have been printed on the upper surface of the substrate 18. For illustrative purposes, the information 12 has been illustrated schematically so as to appear to be above the scrambling pattern 14. In fact, the information 12 and scrambling pattern 14 are virtually in the same plane. However, it will be appreciated that the information has been printed on the substrate 18 after the scrambling pattern 14 was printed on the substrate 18. Thus, the information 12 is illustrated as being "above" the scrambling pattern 14 in FIG. 2.

Once again, the scrambling pattern is printed from a thermochromatic ink such that the optical properties of the background scrambling pattern can be altered upon the application of heat to thereby reveal the overprinted variable information 12.

Figure 3:
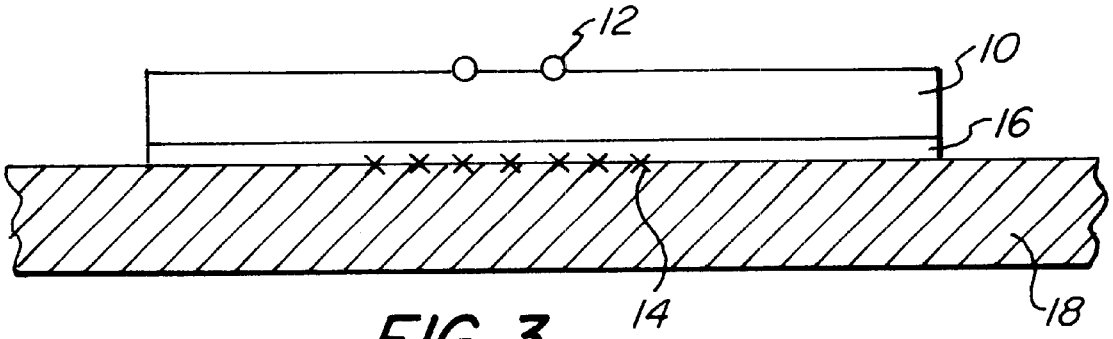
FIG. 3 is a cross sectional view of a third embodiment of the present invention; and, FIG. 4 is a plan view of an example of a background scrambling pattern.

Referring now to FIG. 3, there is illustrated in cross sectional view a third embodiment in which the same reference numerals have been used to indicate the same features. The difference between the first embodiment and the third embodiment resides in the fact that, in the third embodiment, the transparent sheet of material 10 is adhered to a substrate 18 via a layer of transparent adhesive 16. In this embodiment, the scrambling pattern 14 is printed on the upper surface of the substrate 18 and is clearly visible from above through the sheet of transparent material 10 and adhesive 16.

Once again, the scrambling pattern 14 is printed with thermochromatic ink so that its optical characteristics can be altered upon the application of heat to reveal the information 12.

It will of course be appreciated that the above described embodiments are merely illustrative of the broad concept of the present invention and although the invention has been described with reference to a particular arrangement of parts, features and the like, these are not intended to exhaust all possible arrangements or features, and indeed many other modifications and variations will be ascertainable to those of skill in the art.

What is claimed is:

1. A form for concealing variable printed information and including a thermochromatic scrambling pattern, wherein variable information printed over the thermochromatic scrambling pattern cannot be discriminated from the thermochromatic scrambling pattern until heat is applied and the optical properties of the thermochromatic scrambling pattern are altered and wherein the thermochromatic scrambling pattern is on the underside of a sheet of transparent material and wherein the variable information is printed on the upper side of the sheet of transparent material.

2. A form for concealing variable printed information and including a thermochromatic scrambling pattern, wherein variable information printed over the thermochromatic scrambling pattern cannot be discriminated from the thermochromatic scrambling pattern until heat is applied and the optical properties of the thermochromatic scrambling pattern are altered and wherein the thermochromatic pattern is on the upper side of a substrate and wherein the variable information is printed on the upper side of a sheet of transparent material which is adhered to the upper side of the substrate.

3. A form as claimed in claim 1, wherein the alteration of the optical properties of the thermochromatic scrambling pattern is irreversible.

4. A form as claimed in claim 2, wherein the alteration of the optical properties of the thermochromatic scrambling pattern is irreversible.

* * * * *